United States Patent [19]

Roberts

[11] 4,111,021

[45] Sep. 5, 1978

[54] KEY CONSTRUCTION

[75] Inventor: Marvin E. Roberts, 2305 S. Arlington, Reno, Nev. 89509

[73] Assignees: Marvin E. Roberts, Reno, Nev.; James E. Ward, Atherton, Calif.; Reid A. Roberts, Reno, Nev.; Charlene R. Kinkor, Nevada City, Calif.

[21] Appl. No.: 671,010

[22] Filed: Mar. 26, 1976

Related U.S. Application Data

[63] Continuation of Ser. No. 505,367, Sep. 12, 1974, abandoned.

[51] Int. Cl.[2] ..... E05B 19/06

[52] U.S. Cl. ..... 70/406

[58] Field of Search ..... 70/403, 404, 365, 366, 70/409, 376, 377, 411, 406

[56] References Cited

U.S. PATENT DOCUMENTS

| | | | |
|---|---|---|---|
| 1,635,724 | 7/1927 | Morris | 70/403 |
| 2,123,940 | 7/1938 | Gray | 70/377 X |
| 3,695,073 | 10/1972 | Prescott | 70/366 |
| 3,789,638 | 2/1974 | Roberts | 70/366 |
| 3,848,442 | 11/1974 | Martanen | 70/366 |
| 3,928,992 | 12/1975 | Talbot | 70/366 |

FOREIGN PATENT DOCUMENTS

| | | | |
|---|---|---|---|
| 168,167 | 9/1950 | Austria | 70/403 |
| 1,555,343 | 12/1968 | France | 70/377 |
| 883,499 | 11/1961 | United Kingdom | 70/403 |

*Primary Examiner*—Robert L. Wolfe

[57] ABSTRACT

A key construction for use with a rotary disc tumbler lock wherein the key bits consist of a plurality of single planes formed across the transverse axis of the key shank and spaced parallel thereto with each plane capable of aligning its associated tumbler into an open gate position. A key construction for use with a rotary disc tumbler lock wherein longitudinal restricting wards in a plurality of cross-sectional profiles are formable along the key shank and a warded tumbler with a similarly shaped key entry opening, which warded tumbler is used in a lock associated with the warded key thereby providing a plurality of correspondingly shaped warded key entry openings in the lock and key profile configurations which permits locks and keys to be grouped into different series with a key from one group of locks being restricted from entering the locks of another group even though the bitting codes are the same.

2 Claims, 8 Drawing Figures

KEY CONSTRUCTION

This is a continuation of application Ser. No. 505,367, filed Sept. 12, 1974 abandoned.

BACKGROUND OF THE INVENTION

U.S. Pat. No. 3,789,638, Roberts, Cohn and Ward, "Rotary Disc Tumbler Lock Construction", dated Feb. 5, 1974, teaches the art of construction of an improved mechanical, key operated lock with a high degree of resistance to surreptitious entry methods and which is simple and economical to construct. This patent also teaches one method of key construction for the operation of such a lock.

U.S. Pat. No. 3,668,909, Roberts, "Settable Key and Coding Mechanism Therefor", dated June 13, 1972, teaches the art of construction of an improved mechanically settable key for use in conjunction with a lock construction as taught in U.S. Pat. 3,789,638 referred to above.

U.S. Pat. No. 3,905,213, Roberts, "Removable Core Differential Mechanism", dated Sept. 16, 1975, teaches the art of construction of an improved removable core capability and a key adaptation for operating same which is applicable to a lock construction as taught in U.S. Pat. No. 3,789,638 referred to above.

The key constructions and warded tumbler as taught in this application is a continuation of the inventive effort to teach new art as it is discovered on improvements, simplifications and greater adaptability of key constructions related to the above referenced U.S. Patents.

SUMMARY OF THE INVENTION

In general, there is provided herein improved key constructions for the operation of locks incorporating rotary disc tumblers including a warded tumbler construction for use in cooperation with a warded key for use with rotary disc tumbler locks.

In one case, a key with a bitting structure which permits the selective operation of a rotary disc tumbler lock in a clockwise or counterclockwise direction after insertion of the key into a single unobstructed key hole in the lock.

In another case, the structure of each bitting surface on a key which permits the generation of both clockwise and counterclockwise bits, for alignment of gate openings in either direction of rotation of a correspondingly coded key within a lock by the formation of a single bitting plane, one axis of said plane is transverse of the central axis of the key shank and the other axis is parallel to the central axis of the key shank. When a key of this type is formed with a plurality of single bitting planes to correspond to a plurality of rotary disc tumblers of differing rotary angles to align a clear gate opening within a given lock, the single bitting planes formed along the shank of the key differ from one to the other by the angular alignment of their transverse axes each corresponding to an open gate angular rotation of the individual tumblers with which they cooperate.

A key for the operation of a rotary disc tumbler lock wherein the key shank is constructed with at least one warding groove along the longitudinal axis thereof for the purpose of restricting the insertion of the key into locks which are not provided with a correspondingly shaped key hole in at least one warded tumbler within the lock.

A warded tumbler construction for use in a rotary disc tumbler lock wherein the warded tumbler has a key hole shaped to correspond to a warded key configuration to permit passage of a correspondingly shaped key configuration, and to restrict other key configurations.

OBJECTS OF THE INVENTION

It is an object of this invention to provide an improved key for the operation of a bidirectional rotary disc tumbler lock wherein each pair of bittings on the key which drives an associated tumbler in a clockwise or in a counterclockwise rotation in the unlocking operation of the lock is formable as a single plane.

It is a further object of this invention to provide a key construction for use in conjunction with locks incorporating rotary disc tumblers wherein the coded bittings of the key consist of plane surfaces chordal to the key shank and which bittings, regardless of the code angle, engage the entire surface of a corresponding key contact surface on its associated tumbler in the lock.

It is a further object of this invention to provide an improved key construction for the operation of a lock incorporating rotary disc tumblers wherein the key is formed with a cross sectional profile extending longitudinal of the key shank which profile serves to restrict that key for use in locks with a correspondingly shaped key entry opening.

It is a further object of this invention to provide a warded tumbler for use in conjunction with a rotary disc tumbler lock wherein the key entry hole in the warded tumbler is shaped to restrict the insertion of keys whose cross sectional shank profile is not formed to correspond to the shape of the key entry hole in the warded tumbler.

It is a further object of the invention to provide an improved key construction for use in conjunction with rotary disc tumbler locks wherein the key is simple and economical to manufacture.

The foregoing and other objects of the invention will become more readily evident from the following detailed description of a preferred embodiment when considered in conjunction with the accompanying drawings.

DESCRIPTION OF A PREFERRED EMBODIMENT

Figure 1:
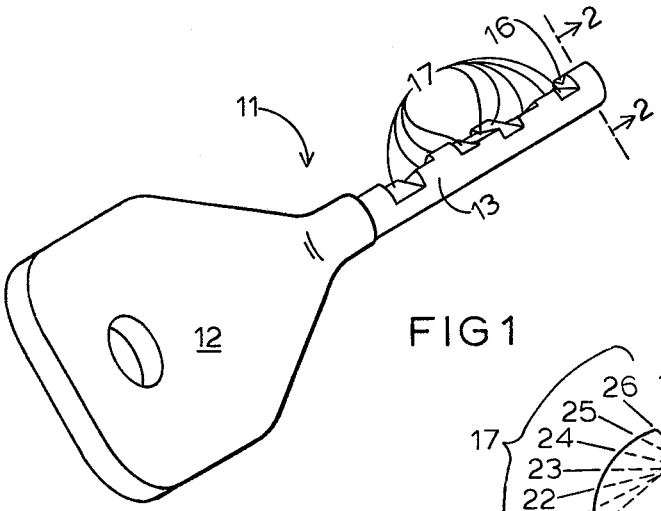
FIG. 1 is an isometric view of a key with single plane bitting surfaces.

Referring to FIG. 1, a key 11 of the type to be used in cooperation with a rotary disc tumbler lock, said key having a key bow 12, shank portion 13 and formed along shank portion 13, bitting planes 17, each plane corresponding to an individual tumbler within a lock. All of the bitting planes 17 along shank portion 13 are formed with one of their axes parallel to the longitudinal axis of shank 13 and with the other axis of each plane formed at various angles transverse of shank 13 which angles correspond to the opening codes of their individually associated rotary disc tumblers within a given lock.

Figure 2:
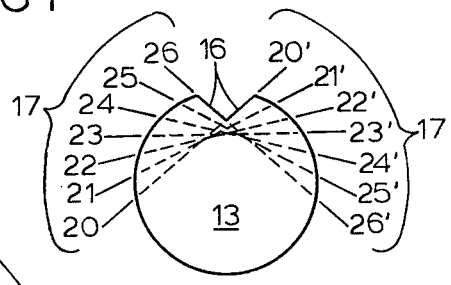
FIG. 2 is an end view of the shank of the key in FIG. 1 taken along lines 2—2 thereof.

The cross sectional shape of shank 13 of key 11, prior to bitting planes being formed thereon, is best shown in solid line outline of FIG. 2. The vee notch 16 as defined by the solid portions of lines 20–20′ and 26–26′ extends the length of shank 13 prior to bits being formed thereon thereby permitting the key to be inserted into key hole 36 of rotary disc tumbler 30, FIG. 4.

Figure 3:
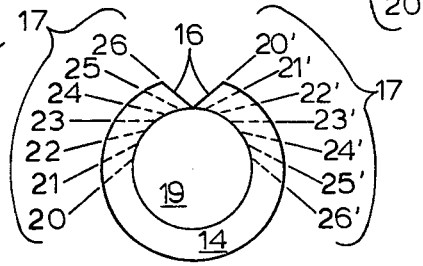
FIG. 3 is an end view of a key shank similar to that shown in FIG. 2 with the shank having a hollow portion extending the length thereof.

The dashed lines 20–20′ through 26–26′ of FIGS. 2 and 3 are typical examples of various transverse angles to which bitting planes may be formed along shank 13 of key 11.

Single bitting planes 17 which cooperate with an associated one of rotary disc tumblers 30 within a lock are formed as by milling shank 13 along one of the dashed lines 20–20′, 21–21′, 22–22′, 23–23′, 24–24′, 25–25′ or 26–26′. When a single bitting plane is so formed, that portion of the plane which contacts tumbler key contact surface 37 of tumbler 30 upon clockwise rotation of the key in the lock is the clockwise bitting which rotates tumbler 30 in a clockwise rotation until an open gate position 32 is rotated and aligned with others in the lock to permit the lock to be opened and that portion of the same plane which contacts tumbler key contact surface 38 of tumbler 30 upon counterclockwise rotation of the key in the lock is the counterclockwise bitting which rotates tumbler 30 in a counterclockwise rotation until an open gate position 32 is rotated and aligned with others in the lock to permit the lock to be opened.

Double bitting planes are formable on shank 13 as by milling along one of dashed lines 20–20′ through 26–26′ and then by milling along any one of the other dashed lines in the same axial position. With either one or two bitting planes 17 formed on shank 13 or 14 in the same axial position, the surface of each bitting plane is sufficiently extensive to contact the entire key contact surface 37 or 38 during the rotation of the key in a lock in a clockwise or counterclockwise direction.

FIG. 3 is an end view of an alternate shank 14 with center portion 19 thereof being hollow and which permits shank 14 to be formed, as for example, from sheet metal as a means of achieving economical manufacture.

Figure 4:
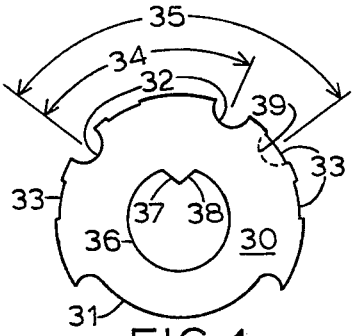
FIG. 4 is a plan view of a rotary disc tumbler with a key hole formed to cooperate with a key shank as in FIGS. 1, 2 and 3.

Rotary disc tumbler 30 in FIG. 4 has a key hole 36, including key contacting surfaces 37 and 38, of a shape to receive key shank 13 or 14 therethrough and to cooperate with a correspondingly bitted key in the operation of a lock. True gates 32 are formed at a uniform angle 34, one to the other, in all tumblers when single bitting planes are formed on the key shank for each tumbler. Other true gates, one such as is shown in phantom at 39 with different angles, as for example 35, are included in tumblers for use in cooperation with a key bitting consisting of two bitting planes for each associated rotary disc tumbler.

False gates 33 may be provided at other than true gate positions in the rotary disc tumblers and a centering spring recess 31 is formed in the tumblers in a lock of a type, for example, as used in a lock construction described in the above referenced U.S. Pat. No. 3,789,638.

Figure 5:
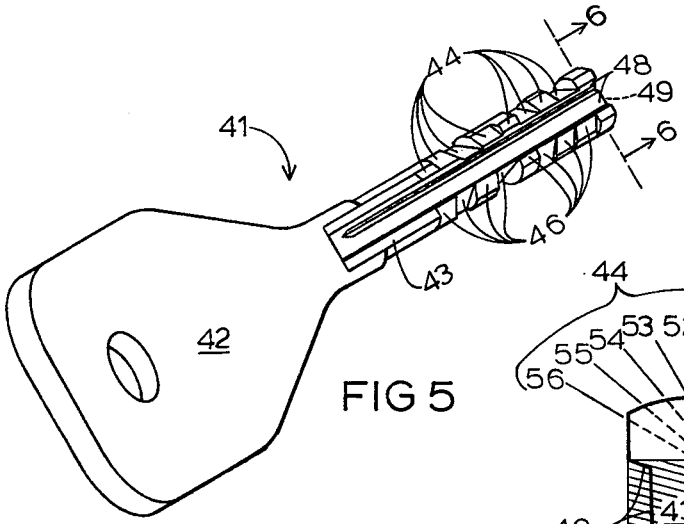
FIG. 5 is an isometric view of a key with bitting surfaces formed along the key shank and with warding grooves formed longitudinal of the key shank and parallel thereto.

Now referring to FIG. 5, a key 41 of the type for use with a lock incorporating rotary disc tumblers, said key having a bow 42, a shank portion 43, warding grooves 48, 49 formed along shank 43 and parallel to its longitudinal axis, bitting planes 44, 46 formed along shank 43, planes 44 for use in cooperation with the rotary disc tumblers of a correspondingly coded lock in one direction of operation and planes 46 for use in cooperation with the rotary disc tumblers of said lock in the opposite direction of operation.

Figure 6:
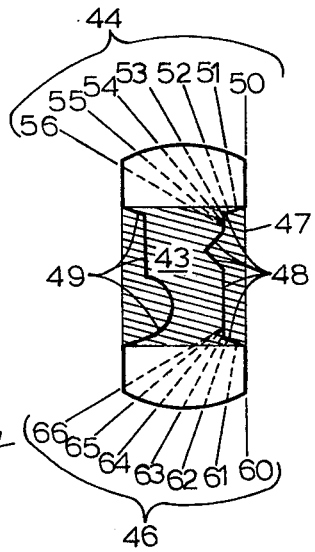
FIG. 6 is an end view of the shank of the key in FIG. 5 taken along lines 6—6 thereof.
Figure 7:
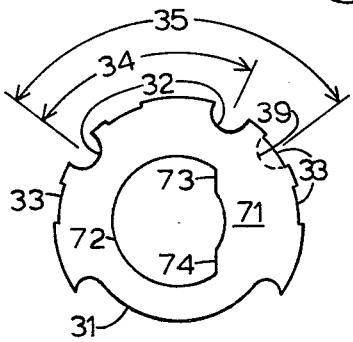
FIG. 7 is a plan view of a rotary disc tumbler with a key hole formed to cooperate with a key shank as in FIGS. 5 and 6.

While FIGS. 5 and 6 illustrate bitting planes 44, 46 formed along one side of key shank 43 and FIG. 7 illustrates a tumbler 71 with a key hole 72 formed to cooperate therewith, it will be readily apparent to those practiced in the art that bitting planes 44, 46 may be formed along the opposite side of key shank 43 with tumbler 71 reversed along the perpendicular center thereof to accomodate same.

Warding grooves 48, 49 are formable in a plurality of shapes along shank 43 within the shaded portion 47 of FIG. 6, the only restriction to the configuration of these grooves 48, 49 being that sufficient strength remain in shank 43 to support bitting planes 44, 46.

Bitting planes 44, 46 are formable at a plurality of angular positions as, for example, shown by lines 50 through 56 and 60 through 66 respectively in the same transverse position on shank 43 as best shown in FIG. 6.

As will be obvious to those practiced in the art, a key with warding grooves formed along the shank portion thereof may be formed with only one set of bitting planes 44 or 46 on either of shank 43 for the operation of a lock incorporating rotary disc tumblers having at least one gate opening position or notch 32 formed in the periphery of each tumbler.

Rotary disc tumbler 71 has a central key entry opening 72 with key contact surface 73 to cooperate with an associated one of bitting planes 44 and key contact surface 74 to cooperate with an associated one of bitting planes 46.

Figure 8:
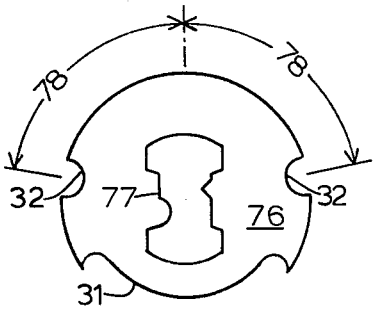
FIG. 8 is a plan view of a rotary disc warded tumbler with a key hole formed to cooperate with a warded key shank as in FIG. 5.

Warded rotary disc tumbler 76, FIG. 8, has a central key entry opening 77 of substantially the same shape as warded shank 43 of key 41 prior to bitting planes being formed on shank 43. Warded key entry opening 77 serves to restrict the insertion of key shanks whose cross sectional configuration does not permit passage therethrough. Key entry opening 77 is formable in a plurality of shapes to correspond to any one of the plurality of cross sectional configurations into which key shank 43 may be formed.

Because key entry opening 77 of warded tumbler 76 is substantially the same shape as the cross section of shank 43 on a key for cooperation therewith, warded tumbler 76 will rotate with key 41 during the full initial rotation of key 41 necessary to align all the open gate tumbler positions 32 in a given lock for either direction of operation thereof, a gate position 32 is provided in warded tumbler 76 at this initial rotation angle 78 on at least one side of the vertical center line of warded tumbler 76. In a birotational lock, two such gate openings 32 are provided, each at angle 78 from the vertical centerline as in FIG. 8. A warded tumbler may be placed in a lock at any position normally occupied by a standard rotary disc tumbler.

I claim:

1. A key construction for use in cooperation with a lock incorporating rotary disc tumblers, said key having a generally circular cylindrical shank, said shank being formed with a vee-shaped groove into said shank longitudinally along said shank parallel to the axis thereof, said groove having a depth radially into said shank less than the radius of the arcuate portion of said shank, the area of any unbitted cross section taken transversely of said shank being less than the area of a circle whose radius is equal to the least radius of any arc of said unbitted cross section, said key being bitted with a plurality of chordal planes formed into said shank to the same radial depth one to the other and spaced longitudinally along said shank, each of said chordal planes cooperating with an associated one of said tumblers in said lock, said chordal planes being offset from but parallel to the axis of key rotation, said planes being formable one to the other at a plurality of angles transversely of said shank, the area of each cross section of said key taken transversely through any of said planes being identical one to the other, each of said planes serving as paired bittings for cooperation with said associated tumbler in said lock, each of said paired bittings rotating said associated tumbler to a coded gate opening position by selective rotation of said key in said lock.

2. A key construction for use in cooperation with a lock incorporating rotary disc tumblers, said key having a generally circular cylindrical shank, said shank being formed with a vee-shaped groove into said shank longitudinally along said shank parallel to the axis thereof, said groove having a depth radially into said shank less than the radius of the arcuate portion of said shank, the area of any unbitted cross section taken transversely of said shank being less than the area of a circle whose radius is equal to the least radius of any arc of said unbitted cross section, said key being bitted with a plurality of chordal planes formed thereinto to the same radial depth one to the other and spaced longitudinally along said shank, said planes being offset from but parallel to the axis of key rotation, said planes being formable one to the other at a plurality of angles transversely of said shank, at least two of said planes being formed as an intersecting pair of planes, each of said pair of planes cooperating with an associated one of said tumblers in said lock, each plane of said pair of planes serving as a single bitting for cooperation with said associated tumbler in said lock, each one of said bittings in each of said pair of planes rotating said associated tumbler to a coded gate opening position by selective rotation of said key in said lock.

* * * * *